United States Patent [19]

Sibalis

[11] 4,161,632

[45] Jul. 17, 1979

[54] PNEUMATIC ACOUSTIC TRANSDUCER WITH FERROMAGNETIC FLUID VALVE

[76] Inventor: Dan Sibalis, 90 Gold St., New York, N.Y. 10038

[21] Appl. No.: 922,067

[22] Filed: Jul. 5, 1978

[51] Int. Cl.[2] ..... H04R 23/00
[52] U.S. Cl. ..... 179/113
[58] Field of Search ..... 179/113

[56] References Cited

PUBLICATIONS

*Electromechanical Design,* Oct. 1973, pp. 6–7.

*Primary Examiner*—George G. Stellar
*Attorney, Agent, or Firm*—Hopgood and Calimafde

[57] ABSTRACT

A novel acoustic transducer utilizing a source of compressed air, the discharge of which is modulated by a ferromagnetic fluid. The ferromagnetic fluid is positioned in a magnetic gap, the intensity of which is modulated by a voice coil which in turn is activated by a varying current.

7 Claims, 2 Drawing Figures

PNEUMATIC ACOUSTIC TRANSDUCER WITH FERROMAGNETIC FLUID VALVE

BACKGROUND OF THE INVENTION

This invention relates generally to an acoustic transducer and more particularly to an acoustic transducer utilizing a source of flowing air which is modulated. Speakers, powdered by a source of compressed air have been known for some time. However, such speakers have utilized a source of compressed air with modulation by a mechanical valve in accordance with the audio signal. Such speakers have suffered from extreme distortion and lack of frequency response because the mechanical valves used to modulate the airflow were far too slow in response to be able to properly track the audio signal.

A large variety of acoustic transducers are known in the art, such transducers when serving as a speaker, employ a moving surface which when coupled to the ambient atmosphere creates sound waves. The driving force of the moving surface may be supplied by electromagnetic, electrostatic or piezo-electric devices. The mass of the moving surface may limit the frequency response and the higher the mass of the moving surface, the greater the power required to move it, which lowers the efficiency of the entire system and also raises its cost. A speaker design utilizing ionized air responding in an electric field has also been used, however, its high cost prevents its widespread use.

SUMMARY OF THE INVENTION

Generally speaking, in accordance with the invention, an acoustic transducer is provided. The transducer utilizes a source of compressed air which is modulated in accordance with an audio signal by a variable air permeativity aperature which utilizes ferromagnetic fluid.

The device has a permanent magnet and a voice coil spaced therefrom, ferromagnetic fluid is placed in the magnetic gap, thus providing a leaking liquid seal which serves as a variable permeativity aperture.

When a voltage is applied to the coil the intensity of the magnetic field within the ferrofluid will vary, thus varying the internal pressure within the ferrofluid and the rate at which the fluid seal leaks, thus modulating the discharge of the compressed air in accordance with the audio signal.

Accordingly, it is an object of this invention to provide an acoustic transducer utilizing a ferromagnetic fluid to modulate a flow of air.

It is another object of this invention to provide an improved acoustic transducer which requires only a small electrical input.

It is further object of this invention to provide an improved acoustic transducer which is relatively small in size.

It is another object of this invention to provide an improved acoustic transducer that is economical to manufacture and has a low overall system cost.

It is further object of this invention to provide an improved acoustic transducer which has a wide frequency response and low distortion.

It is a further objective of this invention to provide a fluidic amplifier capable of producing a net power gain, because the acoustic power is provided by the air compressor, not by the electrical signal.

It is a further object of this invention to provide an improved acoustic transducer which has no moving parts in the transducer subject to wear.

Still another object of this invention is to provide an improved acoustic transducer suitable for use in outdoor applications.

Still other objects of this invention will become apparent upon a reading of the detailed specification to follow.

BRIEF DESCRIPTION OF THE DRAWINGS

For a better understanding of the invention, reference is made to the following drawings, taken in connection with the specification, in which.

DESCRIPTION OF THE PREFERRED EMBODIMENTS

Figure 1:
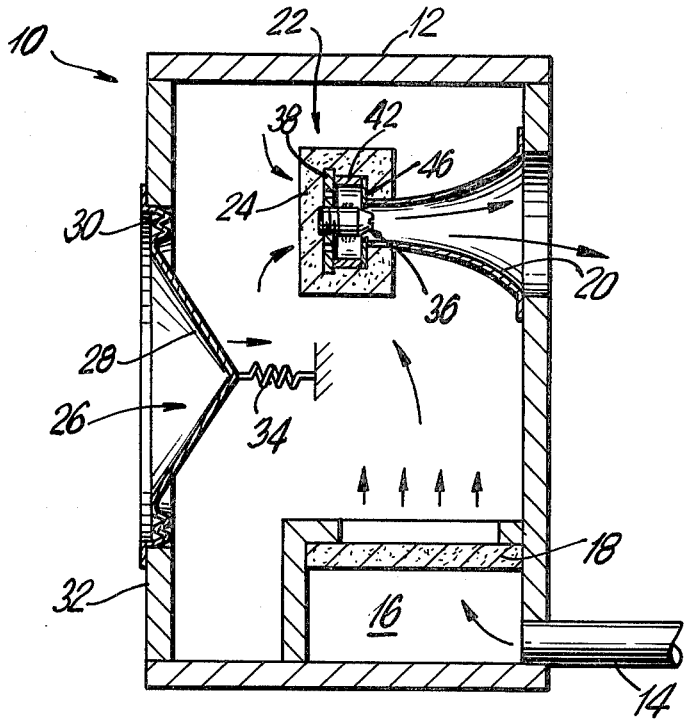
FIG. 1 is a sectional view of an improved acoustic transducer constructed in accordance with the instant invention, shown mounted in a rectangular speaker box.

FIG. 1 of the drawings illustrates the acoustic transducer of the instant invention shown in a preferred embodiment as a speaker generally illustrated at 10. Speaker 10 includes a speaker cabinet 12 which is airtight, generally rectangular in configuration and includes openings for various speaker horns (optional), cones and an inlet for a source of air. A conduit 14 leading from a source of compressed air (not shown) enters at the lower portion of speaker cabinet 12. The source of compressed air may also be self-contained within the speaker cabinet 12. Conduit 14 exhausts into an air chamber 16 which has a air permeable diffusion member 18 through which the compressed air flows, is diffused and any pressure variations are dampened, the air flow then exhausts into cabinet 12. Air entering the interior of cabinet 12 will exit through horn 20 after being modulated by acoustic transducer 22 to produce the desired sound waves. Surrounding acoustic transducer 22 is further diffusion material 24 to further diffuse and dampen the flow of air into acoustic transducer 22. The operation of acoustic transducer 22 is more fully discussed below.

As the air flowing exiting speaker cabinet 12 through horn 20 is modulated by acoustic transducer 22, pressure differentials will occur in the air within cabinet 12. These pressure differentials may be used to power a driver piston 26 to augment the bass response of speaker 10. Driver piston unit 26 includes a cone 28 which is mounted at its periphery by a flexible member 30 which permits cone 28 to be displaced backwards and forwards with respect to the rear wall 32 of speaker cabinet 12. A restoring spring unit, such as the mechanical spring 34 is used to return cone 28 of the driver piston unit to its neutral position.

Figure 2:
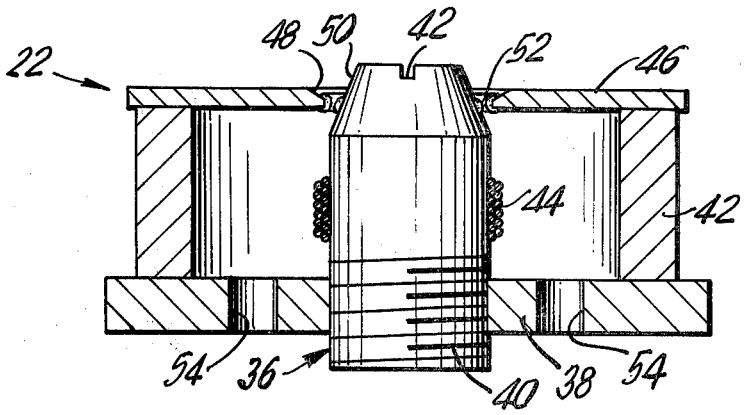
FIG. 2 is an enlarged sectional view of the acoustic transcducer showing the voice coil and permanent magnet.

FIG 2. illustrates the construction of acoustic transducer 22. Acoustic transducer assembly 22 consists of a magnetically permeable pole piece 36 mounted to a frame 38 by means of threads 40 which permit it to be displaced inwardly and outwardly with respect to frame 38 upon insertion of a tool in a slot 42 and a turning motion. Wrapped around pole piece 36 is a stationary voice coil 44 to which the modulated audio voltage will be applied. Extending forwardly from frame 38 is an annular permanent magent. Joined to magnet 42 is an inwardly extending annular plate 46 which has a bevelled edge 48 which is spaced apart from pole piece 36 which has a sloping wall 50 adjacent to edge 48 of plate 46. Thus, sloping wall 50 of pole piece 36, together with its treading, permits the distance between edge 48 of plate 46 and wall 50 to be adjusted.

A ferromagnetic fluid 52 is disposed between edge 48 and wall 50 which upon modulation by the electrical signal of voice coil 44 will vary the opening between edge 48 and wall 50. In operation, air from the interior of cabinet 12 will enter acoustic transducer 22 through openings 54 in frame 38. Air will exit through the gap formed by the ferromagnetic fluid 52 and will be modulated thereby. A voltage, modulated in accordance with the audio signal, will be applied across voice coil 44, which will vary the magnetic field between the pole piece 36 and plate 46 which will cause the ferromagnetic fluid 52 to form a variable leakage seal against the flow of air. The volume of air flowing through the seal will be controlled by the strength of the magnetic field, which in turn is determined by the voltage across voice coil 44 and the intensity of permanent magnet 42. In order to provide adjustment for the gain and power level of the transducer 22, the air gap is adjustable by rotating threaded pole piece 36 so that it moves back and forth with respect to plate 46.

Ferromagnetic fluid 52 may be of a conventional type having controlled viscosity and low vapor pressure. Ferromagnetic fluid 52 could also be replaced by magnetic powder (magnetic particles, alone or in combination with a ferromagnetic fluid), this is possible since the fluidizing effect of the airflow on the magnetic powder will cause it to behave similar to a fluid. The very low mass and viscosity of the ferromagnetic fluid combined with the restoring effect of the magnetic field permits acoustic transducer 22 to reproduce very high frequencies.

Acoustic transducers constructed in accordance with the instant invention may be used in a variety of ways and may be used both to transduce electrical waves into mechanical sound waves and vice versa, mechanical waves into electrical signals. For example, sound waves impinging on ferromagnetic fluid 52 will cause it to move, thus varying the reluctance of the gap, which will produce an electrical output in voice coil 44. Furthermore, a ferromagnetic fluid membrane stretched across a magnetic gap and subjected to a variable magnetic field may act as an underwater sonar speaker and microphone.

Although the present invention has been described in conjunction with preferred embodiments, it is to be understood that modification and variations may be resorted to without departing from the spirit and scope of the invention, as those skilled in the art will readily understand. Such modifications and variations are considered to be within the purview and scope of the invention, and the appended claims, which are intended to cover both the generic and specific features of the invention, and those features, which as a matter of language, may be said to fall therebetween.

What is claimed is:

1. An acoustic transducer for modulating a stream of flowing fluid in accordance with an audio signal comprising, a variable magnetic field, ferromagnetic fluid disposed across said magnetic field in said stream, and means for varying said magnetic field in accordance with said audio signal to thereby vary the flow resistance of said ferromagnetic fluid to modulate said stream.

2. The acoustic transducer as claimed in claim 1 wherein said means for varying said magnetic field comprises a magnetic circuit with a permanent magnet and a gap and an associated electrical inductor, said stream being directed across said gap, means for applying a variable voltage across said inductor in accordance with said audio signal to produce a variable magnetic field in said gap to modulate said ferromagnetic fluid and said stream in accordance with said varying voltage.

3. The acoustic transducer as claimed in claim 2 wherein said inductor is disposed about a ferromagnetic pole piece and said permanent magnet surrounds said pole piece.

4. The acoustic transducer as claimed in claim 3 wherein said magnetic circuit includes a magnetically permeable plate having a opening therein, said pole piece including a sloping periphery and being displaceable to and from said opening in said plate to vary said gap.

5. An acoustic transducer as claimed in claim 1 wherein said transducer further includes a fluidtight box, said box including flowing fluid inlet and outlet means, said flowing fluid first flowing in through said inlet means and out through said outlet means, said variable magnetic field being located proximate to said outlet means.

6. The acoustic transducer as claimed in claim 5 wherein said box further includes a passive driver piston, said passive driver piston being displaced upon the variation of fluid pressure within said box as said fluid flow is modulated.

7. An acoustic transducer as claimed in claim 5 wherein said box further includes diffusion means adjacent to at least one of said inlet means and said outlet means for diffusing said flow of fluid through said box.

* * * * *